United States Patent [19]

Conrad

[11] Patent Number: 4,815,409

[45] Date of Patent: Mar. 28, 1989

[54] STRUCTURAL SAIL WITH IMPROVEMENTS IN LEECH AREA

[75] Inventor: Peter G. Conrad, Old Lyme, Conn.

[73] Assignee: Sobstad Sailmakers, Inc., Old Saybrook, Conn.

[21] Appl. No.: 47,609

[22] Filed: May 8, 1987

Related U.S. Application Data

[63] Continuation of Ser. No. 791,776, Oct. 28, 1985, abandoned.

[51] Int. Cl.[4] ..... B63H 9/04

[52] U.S. Cl. ..... 114/103

[58] Field of Search ..... 114/39, 102, 103, 109

[56] References Cited

U.S. PATENT DOCUMENTS 2,620,760 12/1952 Melges ..... 114/103

OTHER PUBLICATIONS

Milgram, Jerome H., The Design and Construction of Yacht Sails, S. B., Massachusetts Institute of Technology, Cambridge, Mass. (1961).

Milgram, Jerome H., The Design and Construction of Yacht Sails, S. B., Massachusetts Institute of Technology, Cambridge, Massachusetts (1961).

Clemmer, Geroge, "The Calculation of Sail Panels Using Developed Surfaces", The Seventh Chesapeake Sailing Yacht Symposium, Norwall, Mass. (1985).

*Primary Examiner*—Joseph F. Peters, Jr.

*Assistant Examiner*—Jesus D. Sotelo

*Attorney, Agent, or Firm*—Fred A. Keire

[57] ABSTRACT

An improved structural sail with stress bearing members specifically oriented along the leech to eliminate and/or minimize "hard" leech or leech "fall-off".

14 Claims, 1 Drawing Sheet

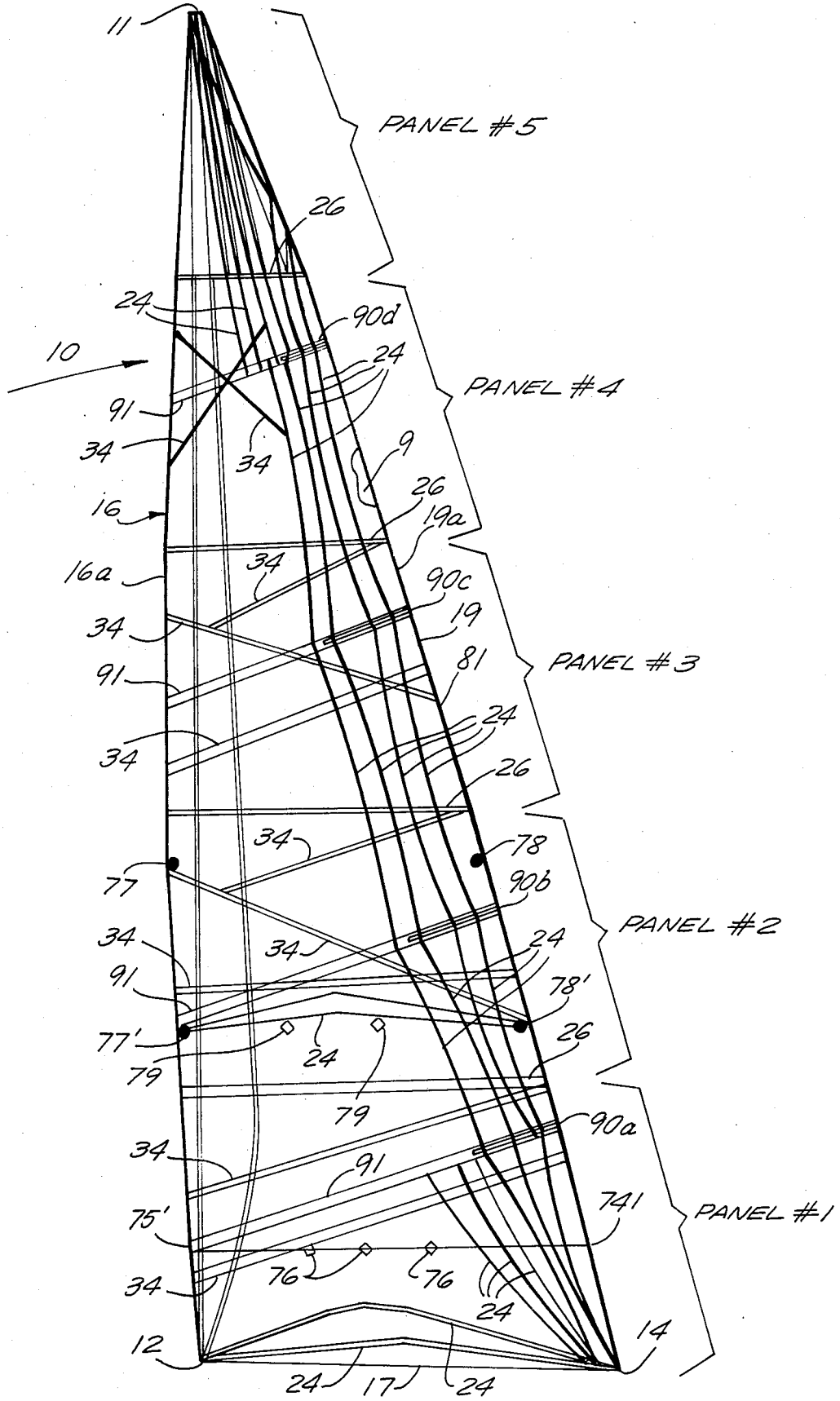
11
PANEL #5
26
24
90d
10
24
PANEL #4
91
34
34
9
26
16
19a
16a
34
90c
34
19
91
81
PANEL #3
24
34
26
34
78
77
90b
PANEL #2
34
34
24
91
78'
77'
24
26
79
79
90a
34
91
741
PANEL #1
75'
76
76
34
24
12
14
24
17
24

STRUCTURAL SAIL WITH IMPROVEMENTS IN LEECH AREA

This application is a continuation of pending application Ser. No. 791,776, filed Oct. 28, 1985, now abandoned.

This invention relates to a lifting surface such as a sail. More particularly, this invention relates to an improved sail where the improvements reside primarily in the leech area of the sail such as a mainsail.

Still further, this improvement seeks to minimize and/or eliminate a chronic problem affecting sails, but especially racing sails, in the area between the leech tape and the inner end of battens.

In my previous application Ser. Nos. 681,933, now U.S. Pat. No. 4,593,639, and 722,268, now U.S. Pat. No. 4,624,205, which are incorporated by reference herein, I have disclosed an improved sail which for the sake of convenience I call a "structural sail". The stresses in the leech and luff area, but to a lesser degree in the foot area, are borne substantially by the structural members. Thus the "structure", consisting of appropriate "structural" members, bears substantially the major part of the load exerted on the sail such as point loads and aerodynamic loads. A typical point load is a load which a clew, a tack, and a head of a sail will bear. An aerodynamic load is manifested by the bulge in the sail by distention of the wind force on the skin, i.e., the cloth member of the sail.

The present invention is as a result of further developments in my previously disclosed application, and has come about serendipitously because of the unexpected benefits gained when using a sail constructed of structural members, that is, the stress-bearing members and a skin, where the skin bears only a fraction of the loads carried by the structural members.

Thus, as a result of the use of the structural members, such as along a leech of a mainsail, it has been found that further improvements are gained in the sail's performance (as well as the useful life) by particular curvatures imparted to the structural members in the area defined by: the outer edge of the leech, i.e., leech tape from head to clew, within the roach area of the sail, and extending to the end of the battens and somewhat deeper, or about ½ batten length beyond the end of battens, into the mainsail past the inner end of the batten. As it is well known in sailmaking, the inner end of the batten is that which is in the interior of the sail.

The novel curvature of the structural members has produced a smoothing effect on the leech area, has minimized and/or eliminated "leech fall-off", has further improved the life of the sail material around the batten pockets and especially the inner end thereof, and has substantially minimized what is known in the art as "hard leech". A "hard leech" is where the leech area becomes distorted at the inner end of the battens by developing a sharp, discontinuous ridge, causing the mainsail to fall off from the inner batten ends to the outer ends thereof. Such "fall-off" is along an imaginary line drawn from the head to the outer end of the battens extending all of the way into the clew of the sail. This unsightly and, at the same time, speed robbing shape of the sail has now been substantially eliminated and/or minimized by the invention as herein disclosed.

A further improvement in combination with the structural member curvature now disclosed in this application has been achieved by the following additional properly shaped construction elements. Thus the batten pockets are further improved by making these in the conventional manner and then overlaying these with a rather heavier strap material (from that of the sail skin), such as a strap of an aramid fabric or an aramid monofilament material where the warp threads or monofilaments are running parallel to the battens. These will be called "overlay straps" and are on both sides of the sail, i.e., the windward and leeward sides of the sail. In addition, parallel to each of the battens (either above or below), one or two straps on one or both sides of the sail and on one or both sides of the battens may be used, but spaced apart from the first "overlay strap". These are called "alongside straps", and such additional straps somewhat oriented alongside to the "overlay straps" are of the same material that is being used for the "overlay straps" and help to minimize and/or eliminate "leech fall-off".

The distance of these "alongside straps" as measured from the battens may be varied. Either one or two straps may be used. If two straps are used, these straps may be either parallel or converging from a spaced apart point at the outer end of a batten to a point on the luff (or even at a point where these "alongside straps" cross each other short of the luff but inside the sail, i.e., between the luff and the inner end of the battens). Preferably these straps extend only to the inner, i.e., closest to the luff, structural elements. These "alongside straps" may be varied, based on the size of the sail and/or the weight of the material, but may range to about 1/5 of the distance to the next batten to about at most ⅓ of the distance to the next batten measured along the leech of the sail. However, this distance may be as little as 1/10 and again may be varied depending on the size of the sail. The width of the strip or the structural element may also be from about 0.5 to 1.5 the width of the overlay strap for the batten pocket.

Typically, the material which overlays the batten will be about from 4 inches to about a foot, again depending on the size of the sail, the larger width being for larger boats such as what are known as "maxiboats" which are about from 73 to 80 feet in length.

Supplemental to the above described variation, cross-structural members and grid members, but not across the concave-convex structural members (as further described herein), may be placed to stabilize further said sail in the manner as disclosed in my previously filed applications, now U.S. Pat. Nos. 4,593,639 and 4,624,205.

Description of the sail may best be visualized by reference to the drawing wherein the Figure herein shows in a plan view a mainsail according to the invention.

Turning now to the Figure, the mainsail 10 consists of a head 11, a tack 12 and a clew 14. These are commonly known as point load locations. In addition, point load locations are found when a sail is reefed such as for the flattening reef (not shown) and first reef identified as 75' and 74' by their tack and clew points of the first reef, respectively, as well as by the subsequent reef points, e.g., second and third reef locations. These are for the second reef as 77' and 78 for the tack and clew, respectively, and 77 and 78 for the third reef for the tack and clew, respectively. Additional reef line points to gather the bulk of the sail and tie it on a boom are identified as 76 for the first reef and 79 for the second reef. The battens 90 beginning at the bottom of the sail are shown as **90*a*, 90*b*, 90*c* and 90*d*, and are found along the leech 19 of the sail. The luff of the sail is shown as 16, and the foot of the sail is shown as 17. The roach area of the sail, that is the area projecting outwardly when a straight line is drawn from the head of the sail 11 to the clew 14 of the sail 10 is identified as 81**.

Stress bearing structural members 24 of the sail are placed along the leech 19 of the sail interior thereof and are all shown as 24. Representative stress bearing structural members are also shown along luff 16. One or more of the stress bearing members may be used, but the invention resides in the placement of the stress bearing structural members 24 and the proper curvature thereof. Most important are the proper orientations of the stress bearing structural members 24 between the battens, including between the head 11 and the first batten **90*d* at the top of the sail, and the bottom batten 90*a* and the clew 14. These are typically called the upper and lower battens, respectively, and are shown as 90*d* and 90*a*. For racing sails, battens are limited to four in number as defined by, e.g., the "International Offshore Rule" (IOR). The two middle battens are identified as upper middle batten 90*c* and lower middle batten 90*b*. The battens may be perpendicular to the leech 19 of the sail. With the advent of sails which may be furled into a boom by rotating around a foot reefing device, the battens may also be placed parallel to the foot 17 of the mainsail 10** so that these may be properly rolled up with the sail.

When the sail is heavily loaded such as when beating in heavy weather, that is, typically above 20 knots of true wind, the force exerted on the leech becomes sizable. The leech 19 and the adjacent sail area, known in the art as the "leech area", has been previously described above with respect to leech "fall-off". This leech area is heavily loaded because a proper efficiency is gained by the shape of the sail, but most favorably by a proper shaping of the leech area during sailing. However, the proper leech shape is first built into the sail in the sailmaking process, but importantly, this shape is achieved by the proper tensioning of the leech area both as a result of main sheet tension and outhauling the clew 14 and further, although to a lesser degree, by flattening the sail such as by bending the spar and/or exerting tension on the sail along the luff thereof by either tensioning the main halyard or the Cunningham line (this takes out the excess curvature in the sail and tends to flatten it and thus depower the sail).

When the leech area (as defined above) becomes more and more loaded, the sail material between the battens tends to assume wrinkles which, in fact, are very shallow waves, i.e., these wrinkles under load are an approximation of a shallow sinusoidal curve. This almost imperceptible wavelike curve causes the following problems. Under heavy leech load, this almost imperceptible curve in a new sail becomes more and more aggravated as the sail material, typically the skin member 9, tends to gather between the inner and outer end of battens. This gathering of the sailcloth or sail material, under load, is restrained by the end of the battens, but nevertheless is transmitted into the cloth or laminate material around the ends of the battens and concentrated in an imaginary area defined by a strip running from the head 11 of the sail along the inner ends of the battens and into the clew 14. The area may be fairly narrow or it may be wider, e.g., up to six inches, depending on the material and degree of irreversible distortion encountered in the leech area.

The above described gathering of the material is believed to be the cause of the leech failure, and thus the "hard leech" for the sail, or as it is called sometimes—a leech which is "falling-off".

The stresses in this area of the sail are fairly enormous, and in my previous patents I have shown that the stress bearing structural members such as 24 in the form of straps can now assume the forces and loads without distorting the skin. As the skin 9 becomes lighter and lighter as a result of the improvements disclosed in my prior two patents, it nevertheless tends to assume the sinusoidal shape, tends to introduce the discontinuity at the inner end of the batten, and tends to produce also what is known as a fluttering leech at the outer end of the batten. This occurs as a result of a number of factors, one of which is that structural members 24, when tensioned, tend to move towards one another, however, as restrained by the battens.

Typically in the prior art as a cure for a fluttering leech, a leech line was being used to take up the flutter by shortening the leech distance, i.e., by hooking the leech 19.

It has now been found that if the stress bearing structural members 24 are placed in a particular configuration, i.e., curvature, between the leech 19 and at the interior of the sail, i.e., from the outer end of battens **90*a* (where the sail may carry a leech tape 19*a*) and the inner end of the battens, the hard leech previously developed in sail material may be minimized and/or eliminated. Such problem is minimized, such as in the laminated aramid-polyester type of sail used as racing sails. The curvature of the stress bearing structural members 24 is important and must be in the area between the batten ends and leech as follows, that is, for each stress bearing member 24 there must be a counteracting stress bearing member 24 in a concave-convex relationship with respect to each other, and although an odd number (or additional number) of stress bearing members 24 may be used and are recommended, such as from the head to the first batten and from the clew to the bottom batten, the convex-concave relationship must obtain for at least two, but in any event all structural members 24**, for the following reasons.

As the leech is being tensioned by exerting a downward pressure on the clew 14 restrained by a halyard attached to the head 11, the pressure taken up by the structural members that are slightly curved tends to prevent the sail material from assuming the sinusoidal shape. This effect is overcome in the skin around the batten pockets primarily by the concavely-convexly placed stress bearing structural members 24. Less importantly, the sinusoidal effect is overcome by additional means such as the "overlay straps" shown as 91 and the "alongside straps" 34 for the battens **90*a* and 90*d*. The curvature thus introduced in the stress bearing structural members 24 acts as a catenary and opposes the formation of the sinusoidal wavelike cloth gathering in the area defined by the ends of the battens extending into the interior of the leech and beyond the inner end of the battens as previously described, i.e., about ½ batten length beyond the interior end thereof. This concave-convex shaping of the stress bearing structural members 24 is noticeable when looking up the leech and generally runs for each foot of the structural members from about ⅛ of an inch to about ½ of the inch at most. For a sail for a 40 foot boat, the distance between the two interior battens is about ten feet. The total curvature, departing from a straight line, is no more than about three inches at the deepest, measured from a straight line between the centerline of the structural members 24 at two batten ends threof. The stress as it is exerted when the sail leech is tensioned and then exerted on the structural members 24** causes the sail skin material not to gather along the batten ends and counters the gathering of the material.

Thus, structural members 24 as now designed and oriented exert a force causing almost a neutral effect of the material between the outside end and the inner end of the battens.

This newly discovered solution to the age old problem applies not only to single ply sails, but also double ply sails as well as sails of a construction where the skin 9 may be of different weights and different laminates. The concave-convex relationship for the stress bearing structural members 24 runs from the head of the sail 11 to the upper batten 90*d*, and then from the upper batten 90*d* to the upper middle batten 90*c*; from the upper middle batten 90*c* to the lower middle batten 90*b*; from the lower middle batten 90*b* to the bottom batten 90*a*, and from the bottom batten 90*a* into the clew of the sail 14. For sails with fewer or more battens the same concave-convex relationship is built into the sail. It has also been found that a concave-convex relationship is functioning best when it is more pronounced at the outer end of the battens, i.e., near the leech 19, and less pronounced at the inner end of the battens, e.g., from about 25 to about 40% along the battens at the inner end thereof. Such orientation seems to be more efficient, although the spacing density of the structural members 24 seems to play a role in avoiding the "hard leech" problem, but is a function of sail size, structural members 24, and curvature thereof, as well as sail material used on the skin.

Thus the concave-convex relationship for the stress bearing structural members 24 runs from the clew to the first batten with the inner batten ends defining the area, while the stress bearing members may still be used further into the sail.

While it is possible that the concave-convex relationship for the stress bearing members may also be arranged at points intermediate the battens, such as for the alongside straps 34, the real benefit flows if the stress bearing structural members 24 are curved between each of the so-called "batten discontinuities" in the sail, i.e., the region around the batten.

As a result of this curvature introduced in the stress bearing structural members 24, the sail no longer tends to distend by working, e.g., by flogging of the leech with its battens.

More importantly for the inner end of batten pockets, the distention is now prevented by the batten pocket overlay straps 91 further aid this sail material stabilization. As a result, structural members 24 prevent the sinusoidal gathering of the material between the ends of the battens and (thus the distending of the material in that area) and also distending by gathering sinusoidally from the body of the sail beyond the inner end of the battens. This distention which allows the batten supported leech area including the roach 81 to fall off is thus eliminated. The distentions are now overcome by the stress being pulled opposite to the sinusoidal wave shape that the skin of the sail 9 wishes to assume when placed under tension.

Further, as a result of the concave-convex relationships between the structural members 24, the leech flutter is also eliminated and/or minimized to a considerable degree as the leech tape 19*a* may be made concave between the battens (and when loaded with the concavely formed structural member 24 adjacent thereto now eliminates and/or minimizes the leech flutter). As mentioned above, the center line for the concave-convex relationship for the structural members is slightly towards the outer end of the battens. Thus the structural members 24 towards the leech 19 are curved towards the leech 19, and the structural members towards the luff 16 are curved toward the luff. When more than two structural members 24 are used between the battens, the outer ones, i.e., towards the leech 19, may be less curved. The spacing for the two opposedly curved structural members 24 may be about one foot at the closest point between the two middle battens 90*b* and 90*c* for a sail for about a 40 foot boat. This spacing will again vary for different sized sails. For a maxiboat (80 feet), the number of structrual members 24 may be 8 to 10 at the top and bottom of the sail and six in between the upper and lower battens.

A further effect may be gained now, but in an opposite measure thereof, by placing the luff tape 16*a* and a structural member 24 adjacent thereto in a convex relationship with respect to each other. By exerting now a downward pull on a halyard or a Cunningham line, the material is slightly more easily gathered into the sail and the sail may be more easily depowered.

Thus the two structural members defined by the luff tape 16a and the adjacent structural member 24, when placed under tension, would tend to assume a straight line relationship and thus remove the curvature from the material to the outside of the stress bearing member 24, that is, towards the leech 19 of the sail and gather it in between the luff 16 and the adjacent structural member 24. This allows a further advantageous control of the sail shape for depowering or up-powering the sail (the last when releasing the tension). Although only two structural members 24 have been shown, more than one may be employed along the luff thereof assuming different curvature, that is, with relationship to the luff 16 and the luff tape 16a thereof so that a precise control of the sail shape may be achieved under tension.

The same principle also applies for the structural members 24 along foot 17 of the sail.

Although the last two embodiments, namely—for the embodiment along the luff 16 of the sail and foot 17 of the sail are noted, the major improvement and the significant advantage over the prior art has been observed by the precise placment of the convexly and concavely placed structural members 24, such as between the battens or between the upper batten and the head and the lower batten and the clew 14.

The various materials which are employed are typically those known in the art for sailmaking purposes, that is, for racing sails these are aramid fabrics, aramid-polyester film laminates, aramid monofilaments laminated to polyesters such as Mylar film; mixtures of aramid and polyester yarn fabrics or a polyester fabric with a Mylar laminate in various combinations thereof or a polyester fabric. These may be used as the skin member as well as the structural members. Other materials such as polyalkylene fabrics, such as a newly introduced material A900 and A1000 (now called Spectra 900 or Spectra 1000) available from Allied Corporation of Morristown, N.J., may also be used for constructing the skin and the structural members. However, for the structural member, the aramid materials are preferred. Carbon fibers such as in laminate structure may also be used. For the structural members such as I have described in my previous patent as well as herein, that is, structural members 24 and the batten overlay straps 91 or the alongside straps 34, these materials may be preferably aramid containing fabrics or materials. Typically an aramid base material, either a fabric or a monofilament, is in a laminate such as with a polyester film, e.g., Mylar.

While other structural members may be used for the sail such as the shown cross structural members 26 as I have described these in my previous patents, for the sake of clarity these are not shown in the Figure herein. However, various placements of these structural members as disclosed in my previous patents are possible and are suggested for the purpose of sail construction with the improvement, however, residing in the properly introduced curvature for the stress bearing members, especially along the leech 19 of the sail as disclosed herein. The various panel arrangements and sail construction methods which are employable with the present invention are those typically used in the art, examples of which are disclosed in my previous patents.

As an illustration of all elements for a mainsail for a 40 foot IOR racing boat, it was made as follows:

| Component | Weight/oz./ sailmaker's yard | Material |
|---|---|---|
| skin member 9 | | |
| in luff area | 2.0 | polyester-Mylar |
| in leech area | 3.0 | Kevlar-Mylar |
| structural member 24 | 3.0 | 400 denier Kevlar woven |
| overlay straps 90 | 3.0 | 400 denier Kevlar woven |
| alongside straps 34 | 2.0 | 200 denier Kevlar woven |

The sail dimensions were: luff 50.0 ft.; leech 52.0 ft.; foot 18.0 ft.

Total structural members: six between clew and bottom batten and head and top batten; four between the first, second, third and fourth batten (three spaces).

What is claimed is:

1. In a lifting surface such as a sail wherein the same has a leech area, including a roach, between a head for the sail and clew therefor and wherein the leech area, including the roach, are supported by battens, and stress exerted by the aerodynamic loading and point loading of the sail at the head and at the clew is countered by a plurality of structural members attached firmly to a skin as flat ribbons running from a point load location to a point load location between a head and a clew for said sail, respectively, the improvement comprising:

a plurality of structural members in a leech area wherein the structural members in the leech area are in at least a paired concave-convex relationship with respect to each other between at least two battens between the leech of the sail and interior thereto and an inner end of the battens, whereby upon exertion of the force between the point loads of the head and the point load of the clew the structural members in the leech area bear said stress in a convex-concave relationship acting oppositely to each other, thereby minimizing and/or avoiding distention in the sail material between an outer end of the batten and about the inner end of a batten for said sail.

2. The sail as defined in claim 1, wherein the concave-convex relationship for said structural member in the leech area is between the head of the sail and the first batten, the first batten and the second batten, and each preceding and next successive battens, and between the last batten and the clew for the sail thereof.

3. The sail as defined in claim 1, wherein in the leech area a great number of structural members are between a head and a top batten and clew and bottom batten, than the number of structural members therebetween.

4. The sail as defined in claim 1, wherein along a luff of the sail a structural member interior but proximate to the said luff, bearing the load along the luff, defines at least one area concave between a luff tape for said sail and a structural member.

5. The sail as defined in claim 1, wherein above a foot of the sail at least one structural member is placed in convex form at the top thereof with respect to the foot of said sail from a tack for said sail to a clew for said sail.

6. The sail as defined in claim 5 wherein a plurality of structural members are placed above the foot thereof and in a convex shape with respect to the foot thereof.

7. The sail as defined in claim 1 wherein said structural members in said concave-convex relationship are integral with an overlay strap for a batten.

8. The sail as defined in claim 7 wherein said concave-convex structural members are integral with said overlay strap and an alongside strap for a batten.

9. The sail as defined in claim 1 wherein said structural members in said concave-convex relationship, with respect to said battens and a head for said sail and a clew for said sail, are from head to clew of a triangular mainsail.

10. The sail as defined in claim 1 wherein additional structural members are within a leech area between a head and top batten and a clew and bottom batten for said sail.

11. The sail as defined in claim 1, wherein an imaginary midline is between structural members in said concave-convex relationship and said plurality of structural members are located on either side of said midline, and said midline is closer to the leech with respect to a midpoint of said battens for said sail.

12. The sail as defined in claim 11 wherein the structural members are less curved towards the leech area with respect to interior structural members and a last structural member closest to the leech follows approximately parallel the leech of the sail.

13. The sail as defined in claim 1, wherein in the leech area a greater number of structural members are between a head and top batten than the number of structural members between the top batten and a bottom batten.

14. The said as defined in claim 1, wherein in the leech area a greater number of structural members are between a clew and a bottom batten than the number of structural members between a top batten and the bottom batten. 5

* * * * *